United States Patent [19]

Sugasawa et al.

[11] 4,357,924

[45] Nov. 9, 1982

[54] FUEL INJECTION CONTROL SYSTEM

[75] Inventors: Fukashi Sugasawa, Yokohama; Haruhiko Iizuka, Yokosuka, both of Japan

[73] Assignee: Nissan Motor Company, Limited, Yokohama, Japan

[21] Appl. No.: 196,027

[22] Filed: Oct. 10, 1980

[30] Foreign Application Priority Data

Oct. 12, 1979 [JP] Japan ..... 54-131540

[51] Int. Cl.[3] ..... F02D 13/06; F02B 3/00

[52] U.S. Cl. ..... 123/493; 123/481; 123/198 F

[58] Field of Search ..... 123/493, 481, 198 F

[56] References Cited

U.S. PATENT DOCUMENTS 4,061,055 12/1977 Iizuka et al. ..... 123/481
4,116,169 9/1978 Krupp et al. ..... 123/493 X
4,144,864 3/1979 Kato et al. ..... 123/493
4,173,953 11/1979 Pocholle ..... 123/493
4,214,306 7/1980 Kobayashi ..... 123/493

FOREIGN PATENT DOCUMENTS 2001131 1/1979 United Kingdom .
2006336 5/1979 United Kingdom .

*Primary Examiner*—Raymond A. Nelli
*Attorney, Agent, or Firm*—Schwartz, Jeffery, Schwaab, Mack, Blumenthal & Koch

[57] ABSTRACT

A fuel injection control system is disclosed for an internal combustion engine having fuel injectors. The system comprises fuel cut-off means operable for rendering some of the fuel injectors inoperative only when the engine speed exceeds a first predetermined value during engine deceleration and for rendering the remaining fuel injectors inoperative only when the engine speed exceeds a second predetermined value higher than the first predetermined value during engine deceleration. Control means is provided for increasing the second predetermined value when rapid engine deceleration occurs.

8 Claims, 4 Drawing Figures

FUEL INJECTION CONTROL SYSTEM

BACKGROUND OF THE INVENTION

1. Field of the Invention

This invention relates to a fuel injection control system for use with an internal combustion engine and, more particularly, to a system for cutting off the supply of fuel to the engine during engine deceleration.

2. Description of the Prior Art

Electronic controlled fuel injection systems have already been proposed which include a fuel cut-off device for cutting off the supply of fuel to an internal combustion engine when the throttle valve is fully closed and the engine speed is above a predetemined reference value for fuel economy during engine deceleration.

With such conventional systems, however, any attempt to lower the reference engine speed value so as to provide a wider fuel cut-off range for higher fuel economy, would lead to a sudden engine speed drop at the start of fuel cut-off and a sudden output torque change resulting in a vehicle shock upon fuel supply resumption. This is due to a time lag between an engine speed detection and an actual engine output torque appearance.

In order to suppress any sudden engine speed drop as well as achieve higher fuel economy, improved systems have also been proposed which are adapted to cut off the supply of fuel to some of the cylinders when the engine speed is above a first predetermined value during engine deceleration and cut off the supply of fuel to the remaining cylinders when the engine speed is above a second predetermined value higher than the first predetermined value during engine deceleration. However, such conventional systems have been found unsatisfactory in that when a rapid engine deceleration occurs, for example, just after engine racing, a sudden large engine speed drop appears which would result in engine stalling.

The present invention provides means responsive to rapid engine deceleration for temporarily increasing the lower predetermined engine speed reference value to resume the supply of fuel to all of the cylinders of an engine at a higher engine speed.

SUMMARY OF THE INVENTION

The present invention provides a fuel injection control system for use with an internal combustion engine having fuel injection. The system comprises means for providing, in synchronism with engine rotation, a fuel injection pulse signal, corresponding to the rate of air flow to the engine, for operating the fuel injectors. A signal generator is provided for providing a first signal when the engine speed is above a first determined value and for providing a second signal when the engine speed is above a second predetermined value higher than the first predetermined value. The first signal is used to cut off the fuel injection pulse signal to a predetermined number of the fuel injectors during engine deceleration. The second signal is used to cut off the fuel injection pulse signal to the remaining fuel injectors during engine deceleration. Control means are provided which are responsive to rapid engine deceleration for increasing the first predetermined value.

The signal generator may comprise a first comparator for comparing a voltage corresponding to engine rotation period with a first reference voltage to provide the first signal when the former is lower than the first reference voltage, and a second comparator for comparing the engine rotation period indicative voltage with a second reference voltage lower than the first reference voltage to provide the second signal when the former is lower than the second reference voltage. The control means may comprise a differentiating circuit having its input coupled to the engine rotation period indicative voltage, and means increasingly conductive for reducing the first reference voltage as the output of the differentiating circuit increases. Alternatively, the control means may comprise a differentiating circuit having its input connected through an inverter to the output of the second comparator, and means increasingly conductive for reducing the first reference voltage as the output of the differentiating circuit increases.

In an alternative embodiment, the signal generator comprises first and second counters reset during each rotation of the engine. The first counter counts the number of occurrences of clock pulses of a constant pulse period. The signal generator also comprises a first pulse generator for providing a pulse to the second counter when the first counter indicates a first predetermined count, and a second pulse generator for providing a pulse to the second counter when the first counter indicates a second predetermined count larger than the first predetermined count. A third pulse generator is provided for providing a pulse to the second counter when the first counter indicates a third predetermined count larger than the second predetermined count. The second counter counts the number of pulses applied thereto. Switch means is provided for normally disconnecting the third pulse generator from the second counter. The switch means disconnects the second pulse generator from the second counter and instead connecting the third pulse generator to the second counter when the difference between an engine rotation period value measured during an engine rotation and another engine rotation period value measured during the previous engine rotation exceeds a predetermined value. The first signal is provided when the second counter indicates a 0 or 1 count and the second signal is provided when the second counter indicates a 0 count.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

The details as well as other features and advantages of this invention are set forth below and are shown in the accompanying drawings, in which.

DESCRIPTION OF THE PREFERRED EMBODIMENTS

Figure 1:
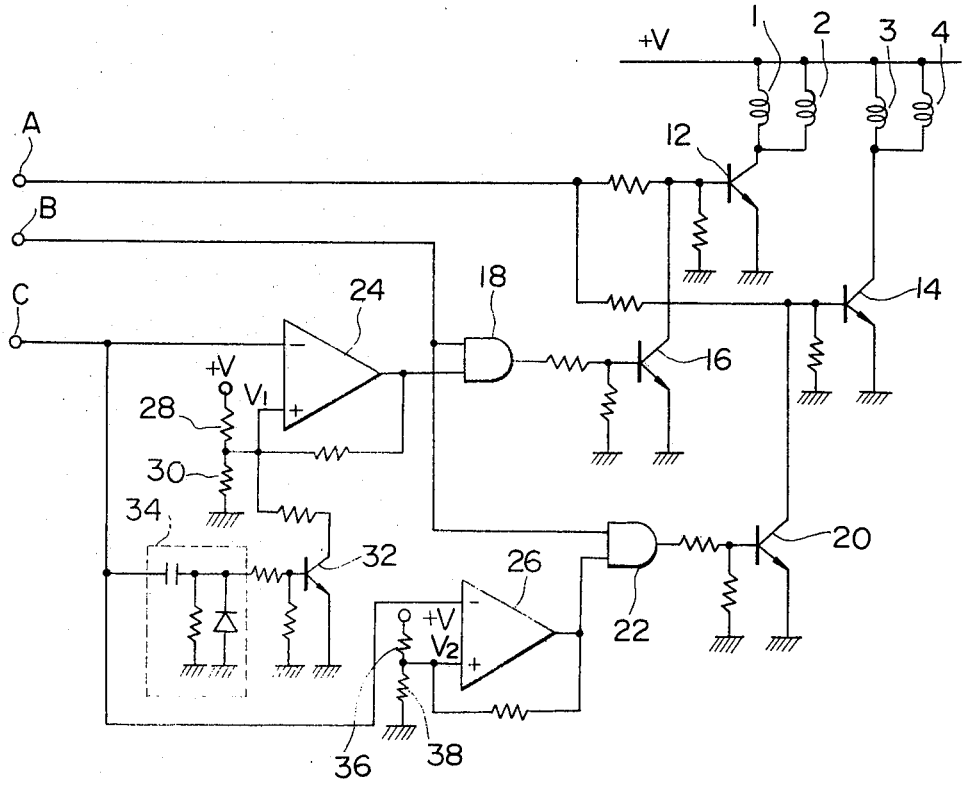
FIG. 1 is a circuit diagram showing one embodiment of a fuel injection control system made in accordance with the present invention.

Referring first to FIG. 1, a fuel injection control system, embodying the present invention, is shown as incorporated in an internal combustion engine having individual fuel injectors 1 to 4 for each of the cylinders of the engine. The fuel injectors 1 to 4 are divided into two groups. The first group of fuel injectors 1 and 2 are commonly connected to ground through the collector-emitter circuit of a first switching transistor 12. The second group of fuel injectors 3 and 4 are grounded commonly through the collector-emitter circuit of a second switching transistor 14. The bases of the first and second transistors 12 and 14 are coupled to a fuel injection pulse signal A corresponding to the rate of air flow to the engine. The fuel injection pulse signal A is generated in synchronism with engine crankshaft rotation from a conventional control unit (not shown). When the fuel injection pulse signal A goes high, the first and second transistors 12 and 14 become conductive to open the first and second groups of fuel injectors, respectively, for a period of time corresponding to the rate of air flow to the engine.

The base of the first transistor 12 is grounded through the collector-emitter circuit of a third switching transistor 16, the base of which is connected to the output of a first AND circuit 18. The base of the second transistor 14 is connected to ground through the collector-emitter circuit of a fourth switching transistor 20 with its base connected to the output of a second AND circuit 22. Each of the first and second AND circuits 18 and 22 has an input B from a throttle switch (not shown) which provides a high output when the throttle valve is in its fully closed position. In this embodiment, engine deceleration is inferred from the high output of the throttle switch. The first and second AND circuits 18 and 22 have a function to render the third and fourth transistors 16 and 20 conductive so as to cut off the fuel injection pulse signal A to the first and second transistors 12 and 14, respectively, when the throttle valve is fully closed; that is, during engine deceleration. The first AND circuit 18 has an additional input connected to the output of a first comparator 24. Also, the second AND circuit 22 has an additional input connected to the output of a second comparator 26.

The first comparator 24 has an inverting input connected to a signal C increasing as the engine speed decreases. The non-inverting input of the first comparator 24 is connected to a reference voltage $V_1$ determined by the ratio of the values of resistors 28 and 30 and also to ground through the collector-emitter circuit of a transistor 32. The base of the transistor 32 is connected through a differentiating circuit 34 to the engine speed indicative signal C. The first comparator 24 compares the engine speed indicative signal C with the reference voltage $V_1$ and produces a low output when the former is higher than the latter. That is, the output of the first comparator 24 is at its low level when the engine speed is lower than a first predetermined engine speed value represented by the reference voltage $V_1$. The differentiating circuit 34 differentiates the engine speed indicative signal C and provides an output representing the rate of decrease of the engine speed. As the output of the differentiating circuit 34 increases, the transistor 32 conducts increasingly to lower the reference voltage $V_1$. That is, the first predetermined engine speed value increases as the engine speed decreasing rate increases.

The second comparator 26 has an inverting input coupled to the engine speed indicative signal C and a noninverting input coupled to a reference voltage $V_2$ determined by the ratio of the values of resistors 36 and 38. The second comparator 26 compares the engine speed indicative signal C with the reference voltage $V_2$ and produces a low output when the former is higher than the latter. That is, the output of the second comparator 26 is at its low level when the engine speed is lower than a second predetermined engine speed value represented by the reference voltage $V_2$. The resistors 28, 30, 36 and 38 are suitably selected such that the reference voltage $V_1$ is higher than the reference voltage $V_2$.

The operation of the fuel injection control system of the present invention will now be described. Assuming first that the engine is gently decelerated but the engine speed is above the second predetermined engine speed value represented by the reference voltage $V_2$ determined by the resistors 36 and 38, all of the outputs of the throttle switch, and the first and second comparators 24 and 26 are high. Consequently, the first and second AND circuits 18 and 22 provides high output to the third and fourth switching transistors 16 and 20 which thereby become conductive to cut off the flow of the fuel injection pulse signal A to the first and second transistors 12 and 14, respectively. This renders the first and second groups of fuel injectors 1 to 4 inoperative to shut off the supply of fuel to the respective cylinders.

When the engine speed falls below the second predetermined value but above the first predetermined value, the output of the second comparator 26 goes low to change the output of the second AND circuit 22 to its low level. This renders the fourth transistor 20 non-conductive to permit application of the fuel injection pulse signal A to the second transistor 14. As a result, the second group of fuel injectors 3 and 4 become operative to resume the supply of fuel to the associated cylinders.

When the engine speed further falls below the first predetermined engine speed value represented by the reference voltage $V_1$, the output of the first comparator 24 goes low to change the output of the first AND circuit 18 to its low level. This renders the third transistor 16 non-conductive to permit application of the fuel injection pulse signal A to the first transistor 12. As a result, the first group of fuel injectors 1 and 2 becomes operative to resume the supply of fuel to the associated cylinders. In this state of the circuit, fuel is supplied through all of the fuel injectors 1 to 4 to the respective cylinders.

If rapid engine deceleration occurs, the output of the differentiating circuit 34 increases to increasingly conduct the transistor 32 so as to decrease the reference voltage $V_1$, whereby the first comparator 24 can provide a low output before the engine speed falls below the first predetermined engine speed value. As a result, the supply of fuel to all of the cylinders can be resumed at an engine speed higher than that predetermined for no rapid engine deceleration. This is effective to suppress engine speed drop resulting from rapid engine deceleration found just after engine racing.

Figure 2:
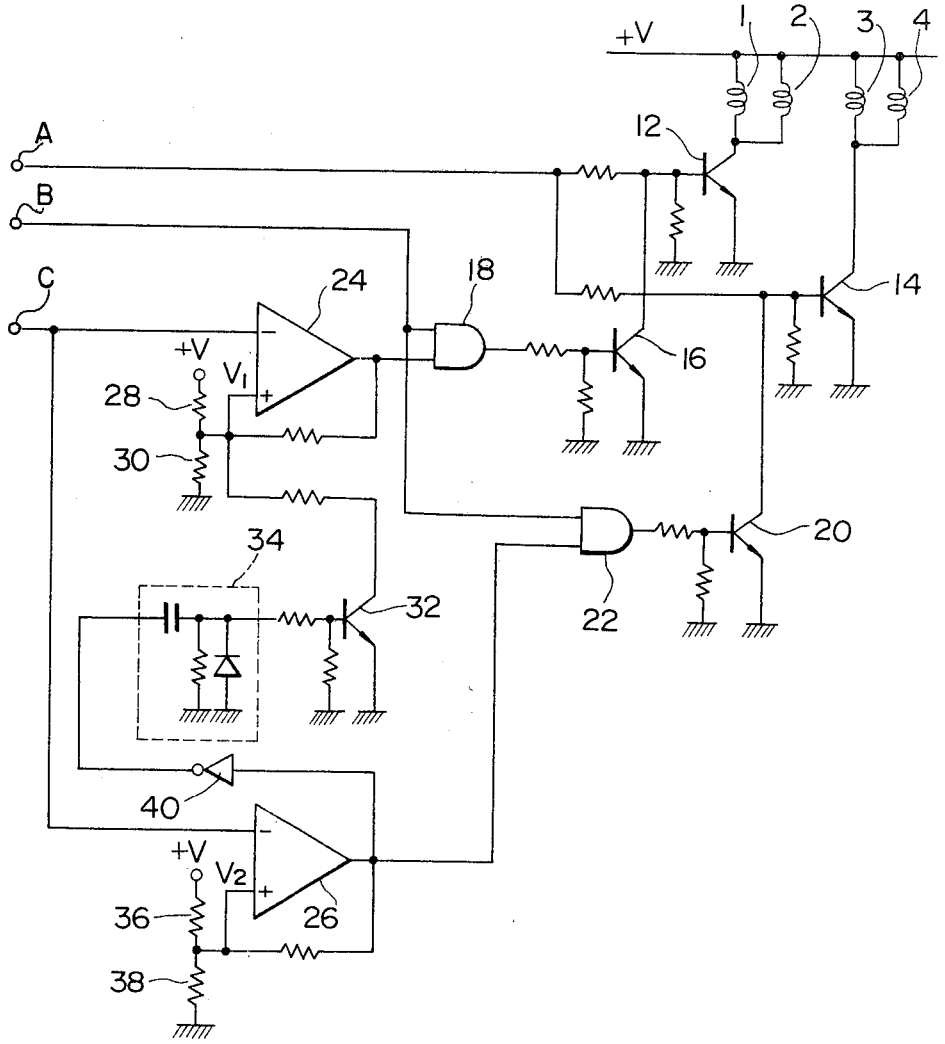
FIG. 2 is a circuit diagram showing a modified form of the fuel injection control system of FIG. 1.

Referring to FIG. 2 a modified form of the fuel injection control system of FIG. 1 is shown. The structure in FIG. 2 is generally the same as shown in FIG. 1 except that the differentiating circuit 34 has its input not connected directly to the engine speed indicative signal C but connected through an inverter 40 to the output of the second comparator 26. Accordingly, like parts are designated by like reference numerals. This modification decreases the reference voltage $V_1$ a predetermined value for a period of time determined by the time constant of the differentiating circuit 34 after the engine speed falls to the second predetermined engine speed value to change the output of the second comparator 26 from its high level to its low level.

Figure 3:
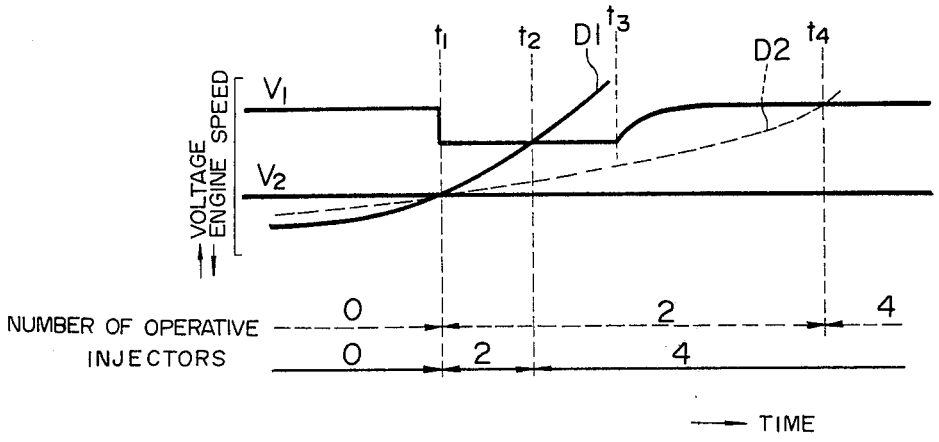
FIG. 3 is a timing chart used in explaining the fuel injection control system of FIG. 2.

With particular reference now to FIG. 3, there are shown two voltage-versus-time waveforms for the reference voltages $V_1$ and $V_2$ in connection with the number of cylinders to which fuel is supplied.

It is assumed that the engine is decelerated rapidly as shown by the solid curve $D_1$ of FIG. 3. When the engine speed decreases to the second predetermined value represented by the reference voltage $V_2$ at a time $t_1$, the output of the second comparator 26 changes to its low level, causing fuel supply resumption for the cylinders associated with the second group of fuel injectors 3 and 4. The low output of the second comparator 26 is applied to the inverter 40 which thereby provides a high signal to the differentiating circuit 34. Consequently, the differentiating circuit 34 increasingly conducts the transistor 32 to lower the reference voltage $V_1$ for a period of time $t_3$–$t_1$ determined by the time constant of the differentiating circuit 34. During rapid engine deceleration, the engine speed indicative signal C increases to the reduced reference voltage or the engine speed decreased to the increased first predetermined value at a time $t_2$ to change the output of the first comparator 24 to its low level, causing fuel supply resumption for the cylinders associated with the first group of fuel injectors 1 and 2.

Assuming then that the engine is decelerated gently as shown by the broken curve $D_2$ of FIG. 3, the output of the second comparator 26 changes to its low level, causing fuel supply resumption for the cylinders associated with the second group of fuel injectors 3 and 4 when the engine speed falls to the second predetermined value represented by the reference voltage $V_2$ at a time $t_1$.

During gentle engine deceleration, the engine speed indicative signal C does not increase to the reduced reference voltage for the time period $t_3$–$t_1$ determined by the time constant of the differentiating circuit 34. Consequently, the output of the first comparator 24 is held high to continuously cut off the supply of fuel through the first group of fuel injectors 1 and 2 to the associated cylinders until the engine speed indicative signal C increases to the reference voltage $V_1$ at a time $t_4$.

It is to be noted that the input of the inverter 40 may be connected to the output of an additional comparator which compares the engine speed indicative signal C with a reference voltage set between the reference voltages $V_1$ and $V_2$ if it is desired, because of drivability and other considerations, to set a large difference between the reference voltages $V_1$ and $V_2$.

Figure 4:
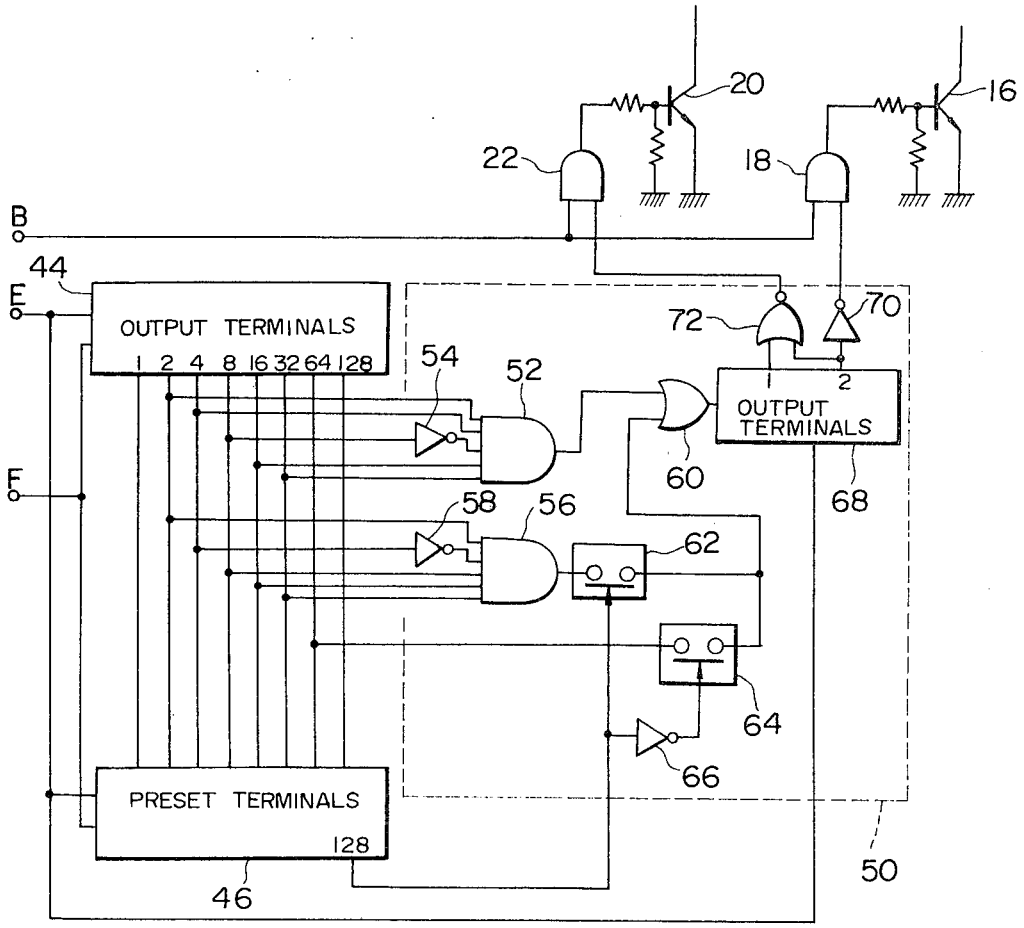
FIG. 4 is a circuit diagram showing a significant portion of an alternative embodiment of the present invention.

Referring to FIG. 4, there is illustrated a second embodiment of the present invention which includes a presettable up-counter 44 having a capacity to count from 0 to 255, a presettable down-counter 46 having a capacity to count from 0 to 255 and latch the final count, and an encoder 50. In FIG. 4, the letter E indicates crankshaft position electric pulses each produced at a predetermined number of degrees of rotation of the crankshaft, and the letter F clock pulses having a 1 m.sec pulse period.

The crankshaft position pulse E is applied to the up-counter 44 which thereby is reset to a value (in this embodiment 5) preset for determination of rapid engine deceleration and increments from the preset value one each time a clock pulse F is applied thereto until the next crankshaft position pulse E is applied thereto. The count made between the two crankshaft position pulses E corresponds to 4 plus the quotient of the engine rotation period divided by 1 m.sec.

The crankshaft position pulse E is applied also to the down-counter 46 which thereby is reset to a value corresponding to the final count on the up-counter 44; i.e., the previous engine rotation period G plus 4 and increments one from the preset value each time a clock pulse F is applied thereto. If the present engine rotation period G' is larger than the preset value G+4, the down-counter 46 decrements back from 255. The 128 output terminal of the down-counter 46 is at a high level when the present engine rotation period G' is larger than the previous engine rotation period G plus 4, and at a low level when the former is equal to or smaller than the latter. Accordingly, it will be understood that the state of the 128 output terminal of the down-counter 46 can be used for determination of a rapid engine rotation period drop or rapid engine speed drop.

The 2, 4, 16 and 32 output terminals of the up-counter 44 are connected directly to respective inputs of a third AND circuit 52, the other input of which is connected through an inverter 54 to the 8 output terminal of the up-counter 44. The third AND circuit 52 provides a high output when the count on the counter 44 reaches 54; that is, when the engine rotation period reaches 50 m.sec. The output of the third AND circuit 52 is connected to one input of an OR circuit 60. The 2, 8, 16 and 32 output terminals of the counter 44 are connected directly to respective inputs of a fourth AND circuit 56, the other input of which is connected through an inverter 58 to the 4 output terminal of the counter 44. The fourth AND circuit 56 provides a high output when the count on the counter 44 reaches 58; that is, when the engine rotation period reaches 54 m.sec. The output of the fourth AND circuit 56 is connected through a first electronic switch 62 to the other input of the OR circuit 60. In addition, the 64 output terminal of the counter 44 is connected through a second electronic switch 64 to the other input of the OR circuit 60. The first electronic switch 62 has a control input connected to the 128 output terminal of the down-counter 46. The second electronic switch 64 has a control input connected through an inverter 66 to the 128 output terminal of the down-counter 46. The first and second electronic switches 62 and 64 close in response to a high input.

The output of the OR circuit 60 is connected to an up-counter 68 having a capacity to count from 0 to 3 and latch the count. The crankshaft position pulse E is applied to the up-counter 68 which thereby is reset to zero and increments one each time a positive going pulse is applied thereto from the OR circuit 60. The up-counter 68 latches and outputs the count made just before the application of the crankshaft position pulse E. The output of the up-counter 68 is 0 when the engine rotation period is below 50 m.sec, 1 when the engine rotation period is 50 m.sec or more but below 54 m.sec during rapid engine deceleration or when the engine rotation period is 50 m.sec or more but below 60 m.sec during gentle engine deceleration, and 2 when the engine rotation period is 54 m.sec or more during rapid engine deceleration or when the engine rotation period is 60 m.sec or more during gentle engine deceleration.

The 2 output terminal of the up-counter 68 is connected through an inverter 70 to one input of the first AND circuit 18, the other input of which is connected to the throttle position indicative signal B. The inverter 70 provides a high output to the first AND circuit 18 when the output of the counter 68 is 0 or 1. The 2 output terminal of the counter 68 is also connected to one input of a NOR circuit 72, the other input of which is connected to the 1 output terminal of the counter 68. The output of the NOR circuit 72 is connected to one input of the second AND circuit 22 having the other input coupled to the throttle position indicative signal B. The NOR circuit 72 provides a high output to the second AND circuit 22 when the output of the counter 68 is 0.

The operation is as follows: Assuming first that the engine is gently decelerated, the throttle switch provides a high output and the difference between the values G and G' is 4 or less to cause the dwon-counter 46 to provide at its 128 output terminal a low output which opens the first switch 62 and closes the second switch 64.

When the engine rotation period is below a first predetermined value of 50 m.sec, the count on the up-counter 44 cannot reach 54 and thus the output of the third AND circuit 52 is held at a low level. Consequently, the up-counter 68 receives no pulse and indicates a zero count. As a result, the inverter 70 provides a high output to the first AND circuit 18 which thereby cuts off the supply of the fuel injection pulse signal to the first group of fuel injectors 1 and 2. In addition, the NOR circuit 72 provides a high output to the second AND circuit 22 so as to cut off the supply of the fuel injection pulse signal to the second group of fuel injectors 3 and 4.

When the engine speed decreases to increase the engine rotation period above 50 m.sec but below a second predetermined value of 60 m.sec, the output of the third AND circuit 52 changes to its high level to provide a pulse to the up-counter 68 when the up-counter 44 indicates a 54 count. This changes the output of the up-counter 44 to 1. As a result, the output of the NOR circuit 72 is changed to its low level which is applied to the second AND circuit 22 to permit application of the fuel injection pulse signal to the second group of fuel injectors 3 and 4 so as to resume the supply of fuel through them to the associated cylinders. The output of the inverter 70 is held high to continuously cut off the supply of the fuel injection pulse signal to the first group of fuel injectors 1 and 2.

When the engine speed further decreases to increase the engine rotation period above 60 m.sec, the output of the third AND circuit 52 changes to its high level to provide a pulse to the up-counter 68 when the up-counter 44 indicates a 54 count and the 64 output of the up-counter 44 changes to a high level to provide a pulse through the second switch 64 to the up-counter 68 when the up-counter 44 indicates a 64 count. This changes the output of the up-counter 44 to 2. As a result, the output of the inverter 70 is changed to its low level which is applied to the first AND circuit 18 to permit application of the fuel injection pulse signal to the first group of fuel injectors 1 and 2 so as to resume the supply of fuel through them to the associated cylinders. The output of the NOR circuit 72 is held low to continuously permit the application of the fuel injection pulse signal to the second group of fuel injectors 3 and 4. Since the first switch 62 is open, the state of the circuit cannot be changed when the engine rotation period reaches 60 m.sec.

If the engine is rapidly decelerated, the difference between the values G and G' becomes larger than 4 and the 128 output of the down-counter 46 changes to is high level so as to close the first switch 62 and open the second switch 64.

When the engine rotation period is below 50 m.sec, the count on the up-counter 44 cannot reach 54 and thus the output of the third AND circuit 52 is held at a low level. Consequently, the up-counter 68 receives no pulse and indicates a zero count. As a result, the inverter 70 provides a high output to the first AND circuit 18 which thereby cuts off the supply of the fuel injection pulse signal to the first group of fuel injectors 1 and 2. The NOR circuit 72 provides a high output to the second AND circuit 22 so as to cut off the supply of the fuel injection pulse signal to the second group of fuel injectors 3 and 4.

When the engine speed decreases to increase the engine rotation period above 50 m.sec but below 54 m.sec, the output of the third AND circuit 52 changes to its high level to provide a pulse to the up-counter 68 when the up-counter 44 indicates a 54 count. This changes the output of the up-counter 44 to 1. As a result, the output of the NOR circuit 72 is changed to its low level which is applied to the second AND circuit 22 to permit application of the fuel injection pulse signal to the second group of fuel injectors 3 and 4 so as to resume the supply of fuel through them to the associated cylinders. The output of the inverter 70 is held high to continuously cut off the supply of the fuel injection pulse signal to the first group of fuel injectors 1 and 2.

When the engine speed further decreases to increase the engine rotation period above 54 m.sec, the output of the third AND circuit 52 changes to its high level to provide a pulse to the up-counter 68 when the up-counter 44 indicates a 54 count and the output of the fourth AND circuit 56 changes to a high level to provide a pulse through the first switch 62 to the up-counter 68 when the up-counter 44 indicates a 58 count. This changes the output of the up-counter 44 to 2. As a result, the output of the inverter 70 is changed to its low level which is applied to the first AND circuit 18 to permit application of the fuel injection pulse signal to the first group of fuel injectors 1 and 2 so as to resume the supply of fuel through them to the associated cylinders. The output of the NOR circuit 72 is held low to continuously permit the application of the fuel injection pulse signal to the second group of the fuel injectors 3 and 4. Since the second switch 64 is open, the state of the circuit cannot be changed when the engine rotation period reaches 60 m.sec; that is, when the count on the up-counter 44 reaches 64. It is to be noted that the second predetermined engine rotation period value decreased from 60 m.sec. to 54 m.sec during rapid engine deceleration.

While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

These embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A fuel injection control system for use with an internal combustion engine having fuel injectors, comprising:

(a) means for providing a fuel injection pulse signal, corresponding to the rate of air flow to said engine, to operate said fuel injectors;

(b) a signal generator for providing a first signal when the engine speed is above a first predetermined value and for providing a second signal when the engine speed is above a second predetermined value higher than said first predetermined value;

(c) cut-off means responsive to said first signal for cutting off the fuel injection pulse signal to a predetermined number of said fuel injectors during engine deceleration and responsive to said second signal for cutting off the fuel injection pulse signal to the remaining fuel injectors during engine deceleration; and (d) control means for increasing said first predetermined value during rapid engine deceleration.

2. A fuel injection control system according to claim 1, wherein said signal generator comprises a first comparator for comparing a voltage corresponding to engine rotation period with a first reference voltage to provie said first signal when the former is lower than said first reference voltage, and a second comparator for comparing the engine rotation period indicative voltage with a second reference voltage lower than said first reference voltage to provide said second signal when the former is lower than the second reference voltage.

3. A fuel injection control system according to claim 2, wherein said control means is responsive to rapid engine deceleration for lowering said first reference voltage.

4. A fuel injection control system according to claim 3, wherein said control means comprises a differentiating circuit having its input coupled to said engine rotation period indicative voltage, and means increasingly conductive for reducing said first reference voltage as the output of said differentiating circuit increases.

5. A fuel injection control system according to claim 3, wherein said control means comprises a differentiating circuit having its input connected through an inverter to the output of said second comparator, and means increasingly conductive for reducing said first reference voltage as the output of said differentiating circuit increases.

6. A fuel injection control system according to claim 1, wherein said signal generator comprises first and second counters reset during each rotation of said engine, said first counter adapted to count the number of occurrences of clock pulses, a first pulse generator for providing a pulse to said second counter when said first counter indicates a first predetermined count, a second pulse generator for providing a pulse to said second counter when said first counter indicates a second predetermined count larger than said first predetermined count, said second counter adapted to count the number of pulses applied thereto, and means for providing said first signal when said second counter indicates a 0 or 1 count and providing said second signal when said second counter indicates a 0 count.

7. A fuel injection control system according to claim 6, wherein said control means comprises a third pulse generator for providing a pulse to said second counter when said first counter indicates a third predetermined count larger than said second predetermined count, and switch means for normally disconnecting said third pulse generator from said second counter and for connecting said third pulse generator to said second counter and disconnecting said second pulse generator from said second counter in response to rapid engine deceleration.

8. A fuel injection control system according to claim 7, wherein said switch means comprises means for providing a control signal when the difference between an engine rotation period value measured during an engine rotation and another engine rotation period value measured during the previous engine rotation exceeds a predetermined value, a normally open switch interposed between said second pulse generator and said second counter for connecting them in response to said control signal, and a normally closed switch interposed between said third pulse generator and said second counter for disconnecting them in response to said control signal.

* * * * *